US010883807B2

(12) United States Patent
Dwire

(10) Patent No.: US 10,883,807 B2
(45) Date of Patent: Jan. 5, 2021

(54) NON-LETHAL PAYLOAD PROJECTILE

(71) Applicant: Kathleen M. Dwire, Lenore, ID (US)

(72) Inventor: Kathleen M. Dwire, Lenore, ID (US)

( * ) Notice: Subject to any disclaimer, the term of this patent is extended or adjusted under 35 U.S.C. 154(b) by 0 days.

(21) Appl. No.: 16/544,035

(22) Filed: Aug. 19, 2019

(65) Prior Publication Data

US 2020/0056864 A1 Feb. 20, 2020

Related U.S. Application Data

(60) Provisional application No. 62/720,077, filed on Aug. 20, 2018.

(51) Int. Cl.
*F42B 6/10* (2006.01)
*F42B 14/00* (2006.01)

(52) U.S. Cl.
CPC ..... *F42B 6/10* (2013.01); *F42B 14/00* (2013.01)

(58) Field of Classification Search
CPC ..... F42B 12/40; F42B 12/46; F42B 12/36; F42B 12/367; F42B 8/00; F42B 8/14; F42B 8/16; F42B 10/00; F42B 10/26; F42B 10/32; F42B 10/42; F42B 10/46; F42B 14/02
USPC ..... 102/513, 512, 517, 502, 506; 124/80, 124/41.1, 1
See application file for complete search history.

(56) References Cited

U.S. PATENT DOCUMENTS 4,958,570 A * 9/1990 Harris ..... F42B 14/02 102/439
5,035,183 A * 7/1991 Luxton ..... F42B 8/16 102/447
5,133,261 A * 7/1992 Kelsey, Jr. ..... F42B 10/22 102/439
5,654,524 A * 8/1997 Saxby ..... F42B 12/40 102/502
6,230,630 B1 * 5/2001 Gibson ..... F42B 10/24 102/477
6,543,365 B1 4/2003 Vasel et al.
7,222,573 B2 * 5/2007 Pontieri ..... F42B 6/10 102/501
7,526,998 B2 * 5/2009 Vasel ..... F42B 7/08 102/370
8,875,634 B2 11/2014 Gibson et al.
D765,215 S * 8/2016 Gibson ..... F42B 12/50 D22/115
9,709,368 B2 * 7/2017 Mahnke ..... F42B 10/26
9,766,049 B2 9/2017 Gibson et al.
(Continued)

*Primary Examiner* — Jonathan C Weber
(74) *Attorney, Agent, or Firm* — Duncan Palmatier

(57) ABSTRACT

A non-lethal projectile formed by a front shell, with a hemispherical nose and a cylindrical shaft, and a base at the tail. The hemispherical nose has three or more bi-planar grooves, originating along the junction of the hemispherical nose and cylindrical shaft, extending toward the nose in an inward whorled manner, and terminating around the apex of the hemisphere. The grooves cause the projectile to spin, thereby creating a stabilizing gyroscopic effect when launched. The projectile's base has a domed shape. The convex inner surface of the dome has a profile complimentary to the hemispherical nose of the shell so that multiple projectiles may nest nose to tail when loaded into a multiple round magazine. The convex tail design moves the center of gravity forward and increases the aerodynamic stability and accuracy of the projectile.

14 Claims, 5 Drawing Sheets

(56) References Cited

U.S. PATENT DOCUMENTS

| | | | | |
|---|---|---|---|---|
| 10,436,560 | B2 * | 10/2019 | Carlson | F42B 12/76 |
| 2005/0016412 | A1 * | 1/2005 | Vasel | F42B 7/10<br>102/502 |
| 2005/0066849 | A1 * | 3/2005 | Kapeles | F42B 12/50<br>102/517 |
| 2005/0188886 | A1 * | 9/2005 | Vasel | F42B 6/10<br>102/502 |
| 2006/0011090 | A1 * | 1/2006 | Vasel | F42B 5/16<br>102/512 |
| 2007/0074637 | A1 * | 4/2007 | Pontieri | F42B 10/24<br>102/501 |
| 2008/0178728 | A1 * | 7/2008 | Kapeles | F42B 12/50<br>86/18 |
| 2008/0178758 | A1 * | 7/2008 | Kapeles | F42B 12/34<br>102/502 |
| 2009/0101038 | A1 * | 4/2009 | Kapeles | F42B 12/50<br>102/502 |
| 2009/0266262 | A1 * | 10/2009 | Vasel | F42B 7/08<br>102/370 |
| 2010/0078844 | A1 * | 4/2010 | Kapeles | F42B 10/06<br>264/45.3 |
| 2011/0023744 | A1 * | 2/2011 | Endicott, Jr. | F42B 12/40<br>102/502 |
| 2012/0199034 | A1 * | 8/2012 | Gibson | F42B 12/40<br>102/502 |
| 2014/0318402 | A1 * | 10/2014 | Carlson | F42B 12/76<br>102/439 |
| 2014/0373745 | A1 * | 12/2014 | Carlson | F42B 12/74<br>102/502 |
| 2016/0153757 | A1 * | 6/2016 | Mahnke | F42B 12/02<br>102/501 |

* cited by examiner

MEASURED SPIN (ROTATIONS PER MINUTE) AT DIFFERENT GROOVE ANGLES (E) AND WIDTHS

| PROJECTILE TESTED | GROOVE ANGLE (E) | GROOVE WIDTH (DEG.) | SPIN (RPM) V 106fps* WIND | SPIN (RPM) @ 281fps WIND | SPIN (RPM) @ 367fps WIND |
|---|---|---|---|---|---|
| FN303** | 87 (FINS) | NA**** | 0 | 0 | 0 |
| VXR*** | 83 | 5 | 0 | 3 | 7 |
| SAMPLE # 1 | 24 | 80 | 2,029 | 2,397 | 1,616 |
| SAMPLE # 2 | 30 | 90 | 3,178 | 7.333 | 7,178 |
| SAMPLE # 3 | 32 | 70 | 2,024 | 5,280 | 6,063 |
| SAMPLE # 4 | 32 | 60 | 4,830 | 4,791 | 3,559 |
| SAMPLE # 5 | 34 | 80 | 2,137 | 2,080 | 2,052 |
| SAMPLE # 6 | 36 | 70 | 3,220 | 6,974 | 7,533 |
| SAMPLE # 7 | 45 | 90 | 3,290 | 4,840 | 6,108 |
| SAMPLE # 8 | 48 | 60 | 1,583 | 2,001 | 3,575 |

* FEET PER SECOND
** FN HERSTAL PRODUCT NUMBER
*** UNITED TACTICAL SYSTEMS PRODUCT NAME
**** THE FN HERSTAL FN 303 HAS PROJECTING FINS, NOT GROOVES

FIG. 6

NON-LETHAL PAYLOAD PROJECTILE

1. CLAIM OF PRIORITY TO PROVISIONAL APPLICATION (35 U.S.C. § 119(e))

This application claims priority under 35 U.S.C. § 119(e) from provisional patent Application No. 62/720,077 filed on Aug. 20, 2018. The 62/720,077 application is incorporated herein by reference.

2. FIELD OF THE INVENTION

The present invention relates generally to non-lethal projectiles, and more specifically to aerodynamic forms of such projectiles that enhance their accuracy, speed and distance.

3. BACKGROUND OF THE INVENTION

There are essentially three designs in the marketplace for non-lethal payload containing projectiles. The first, as shown in U.S. Pat. No. 6,543,365 to Vasel et al., is a 68 caliber sphere containing a payload, such as an irritant powder, which is released when the sphere ruptures upon impacting a target. The sphere is unable to develop spin when launched through a smooth bore launcher, which is the standard method of firing. The second design is known as a "shaped projectile" and has a front hemisphere, containing a ballast, separated by a central disc sealing the front portion from the back portion, which contains the payload. The third design is another shaped projectile, as shown in U.S. Pat. Nos. 8,875,634 and 9,766,049 to Gibson et al., comprised of a front hemisphere, containing the payload, which has a flat base sealing it from the back portion, which is shaped like a cylindrical cup, forming a skirt, which may be hollow. Both of the shaped projectiles have ridges running longitudinally at a slight slant on the cylindrical portion of the skirt. These ridges are intended to impart spin but, in actuality, reduce the velocity of the projectile when passing down the smooth barrel of a launcher, because the plastic of which the projectiles are composed does not have the capability of obturating the barrel and, thus allows blow-by of air, decreasing velocity. The ridges are too subtle to impart spin and their placement on the cylindrical shaft portion creates a turbulent boundary layer of air that inhibits the projectile's flight. The first two designs are not easily adapted to "nesting" in a loading tube or magazine, since nesting requires the back portion of one projectile to have concave shape complimentary to the front portion of another projectile lined up behind it. The third design could be adapted to nest, but it is vulnerable to stress breakage in a nesting application.

Projectiles launched through a smooth bore are inherently inaccurate due to their lack of spin. Spin creates an axial gyroscopic stabilizing effect which produces a more consistent trajectory and increased accuracy. Non-lethal projectiles by their very nature are not intended to cause lethal consequences, but if the projectile's flight path is inaccurate or unpredictable due to lack of adequate spin, the projectile can impact the intended live target in a lethal manner by penetrating an eye or other similar vulnerable area.

What is needed is a non-lethal projectile with an aerodynamic design to impart spin to enhance accuracy, speed and distance. Also needed is such a design that also may be nested for rapid loading.

4. SUMMARY OF THE INVENTION

The disclosed invention is a non-lethal projectile formed by a front shell, which has a hemispherical nose and a cylindrical shaft, as well as by a base. The hemispherical nose has three or more hi-planar grooves, originating along the junction of the hemispherical nose and cylindrical shaft, extending toward the nose in an inward whorled manner, and terminating around the apex of the hemisphere. The angle of the grooves, when measured relative to the equator, is in the range between 30 degrees and 60 degrees, and the angle of the two sides of the grooves, when measured transverse to their longitudinal path, is in the range from between 60 and 95 degrees. The hemispherical shell has an interior cavity to contain the projectile's non-lethal payload. The grooves in the hemispherical shell cause the projectile to spin, thereby creating a stabilizing gyroscopic effect when expelled through a smooth bore barrel. The second part of the projectile is its base, which has a domed shape and an annular ring to seal the shell's interior cavity and act as an obturating ring within the barrel of a launcher. The convex inner surface of the dome has a profile complimentary to the hemispherical nose of the shell so that multiple projectiles may nest nose to tail when loaded into a multiple round magazine. The convex tail design also creates a more nose forward center of gravity, thereby increasing the aerodynamic stability of the projectile.

5. DESCRIPTION OF THE DRAWINGS

FIG. 6 is a table of test results for embodiments of the present invention and commercially-available projectiles.

6. DETAILED DESCRIPTION OF THE INVENTION

Figure 2:
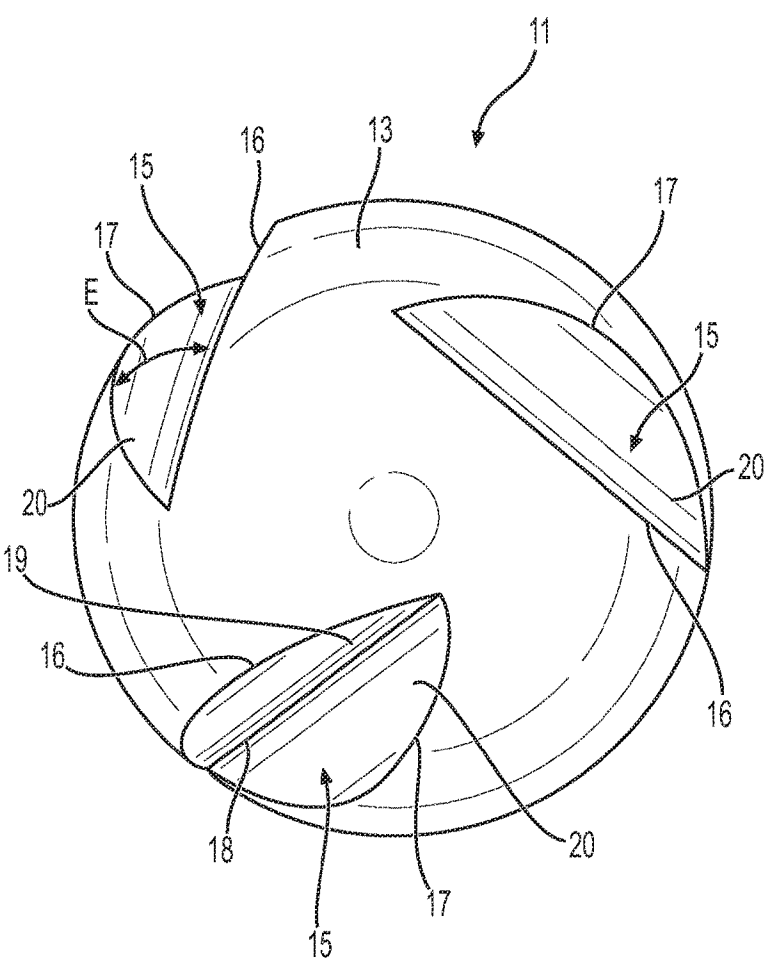
FIG. 2 shows a top perspective view of the projectile.
Figure 1:
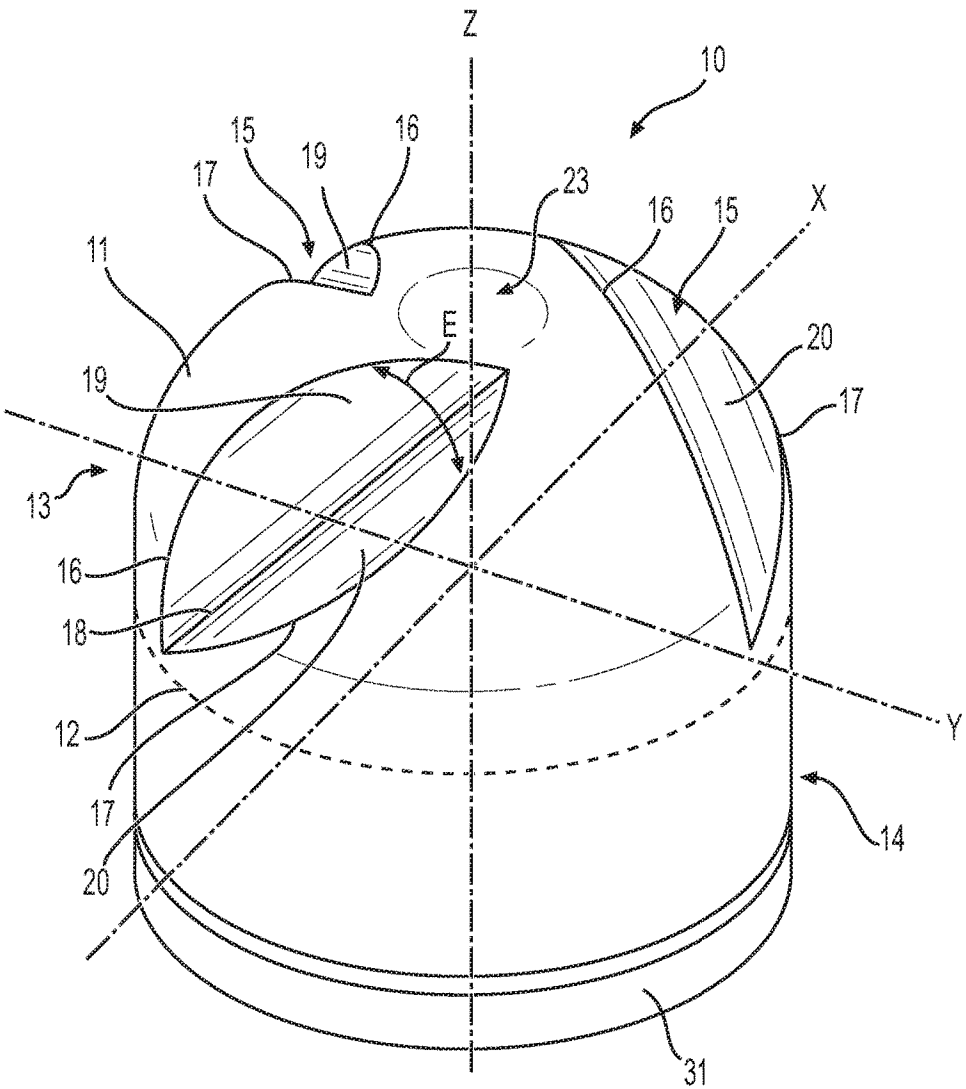
FIG. 1 shows a side perspective view of the projectile of the present invention.
Figure 3B:
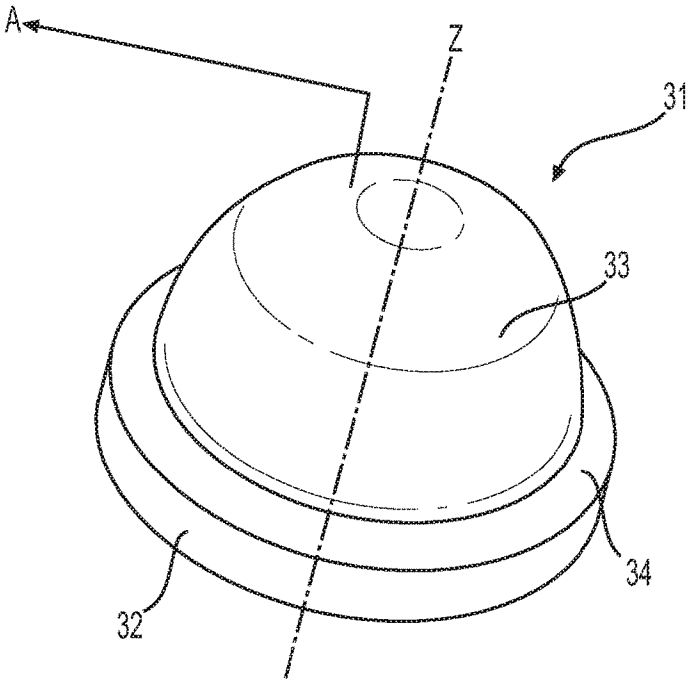
FIGS. 3A and 3B show an exploded perspective view of the front (FIG. 3A) and base (FIG. 3B) portions of the projectile.
Figure 3A:
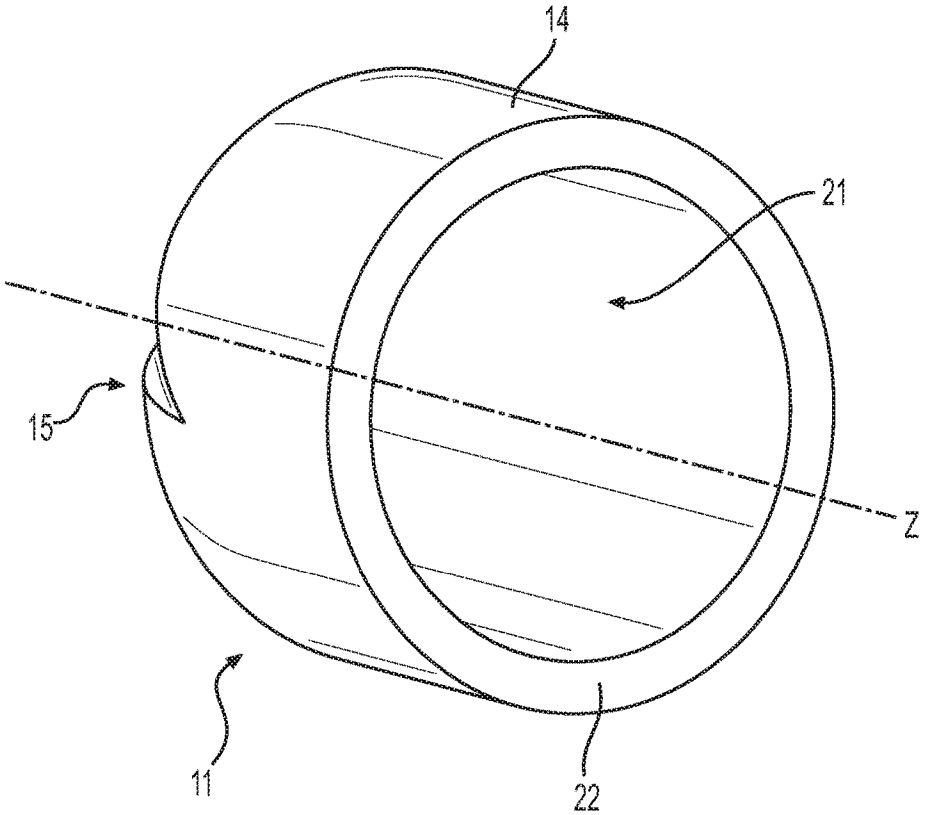

This invention is a projectile intended to be fired through a smooth bore launcher (not shown) propelled by a compressed gas, typically compressed air. The size is 68 caliber, the same as recreational "paintballs" and "Pepperballs" of non-lethal marketed projectiles, although the design disclosed here may be applied to other sizes of non-lethal projectiles, such as 12 gauge, 37 mm, and 40 mm. Launchers for 68 caliber projectiles are typically smooth bore and use compressed gas to launch the projectile.

As shown in FIGS. 1 through 3B, the projectile 10 has two parts, a hollow front shell 11 and a base 31 at the back end or tail. The hollow front shell 11 forms an interior volume 21 intended to contain a variety of payloads (not shown), typically containing a pungent capsaicin compound as found in red peppers. This projectile 10 is intended to be used for crowd control and other non-lethal uses of force. The payload is retained within the interior volume 21 by the base 31, where the bottom edge 22 of the shell 11 mates with the top surface 34 of the annular rim 32 of the base 31. The rim 32 assists in providing obturation between the projectile 10 and the barrel of the launcher (not shown). A sealing ring (not shown) may also be placed between the shell's bottom edge 22 and the top surface 34 of the base 31.

Figure 4:
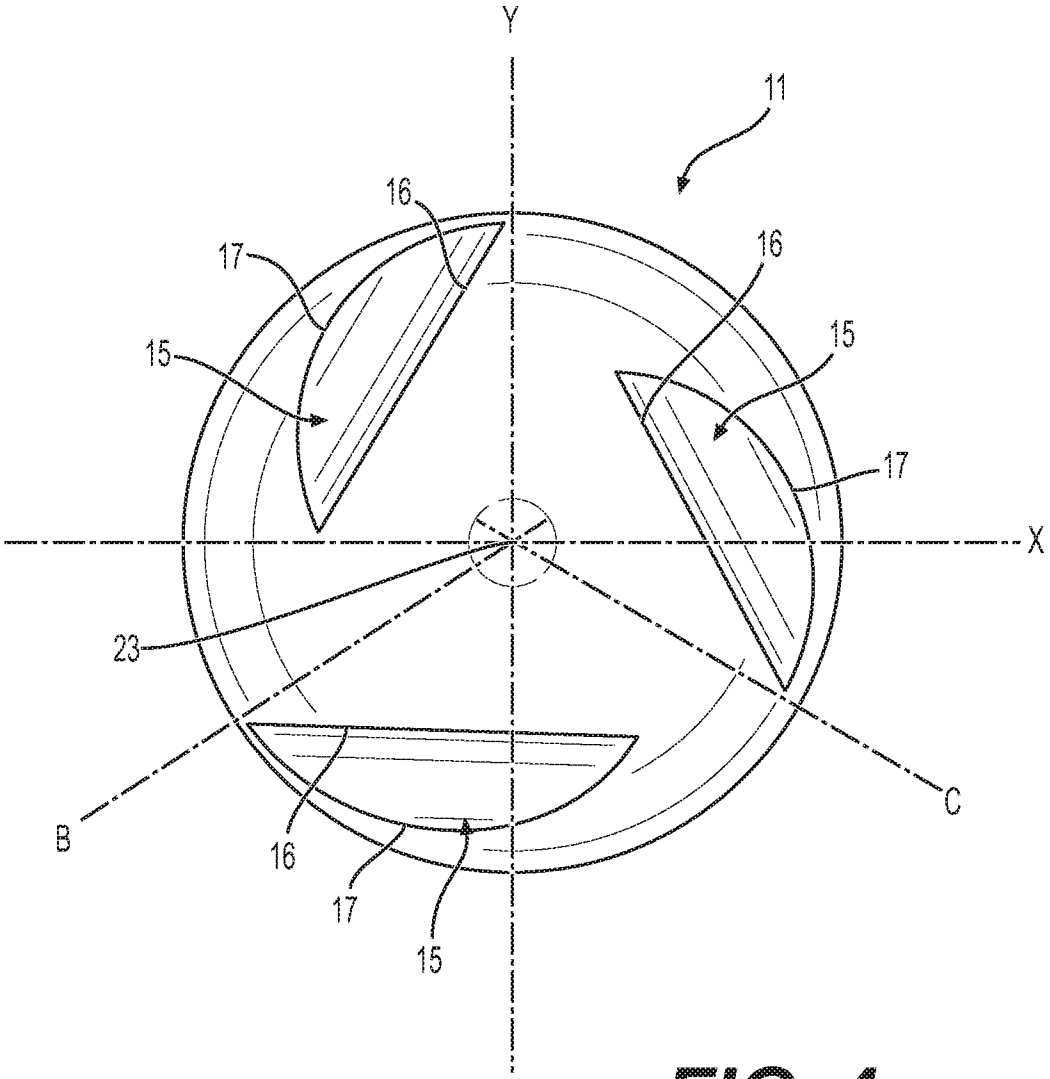
FIG. 4 shows a side cut-away view of the projectile.
Figure 5:
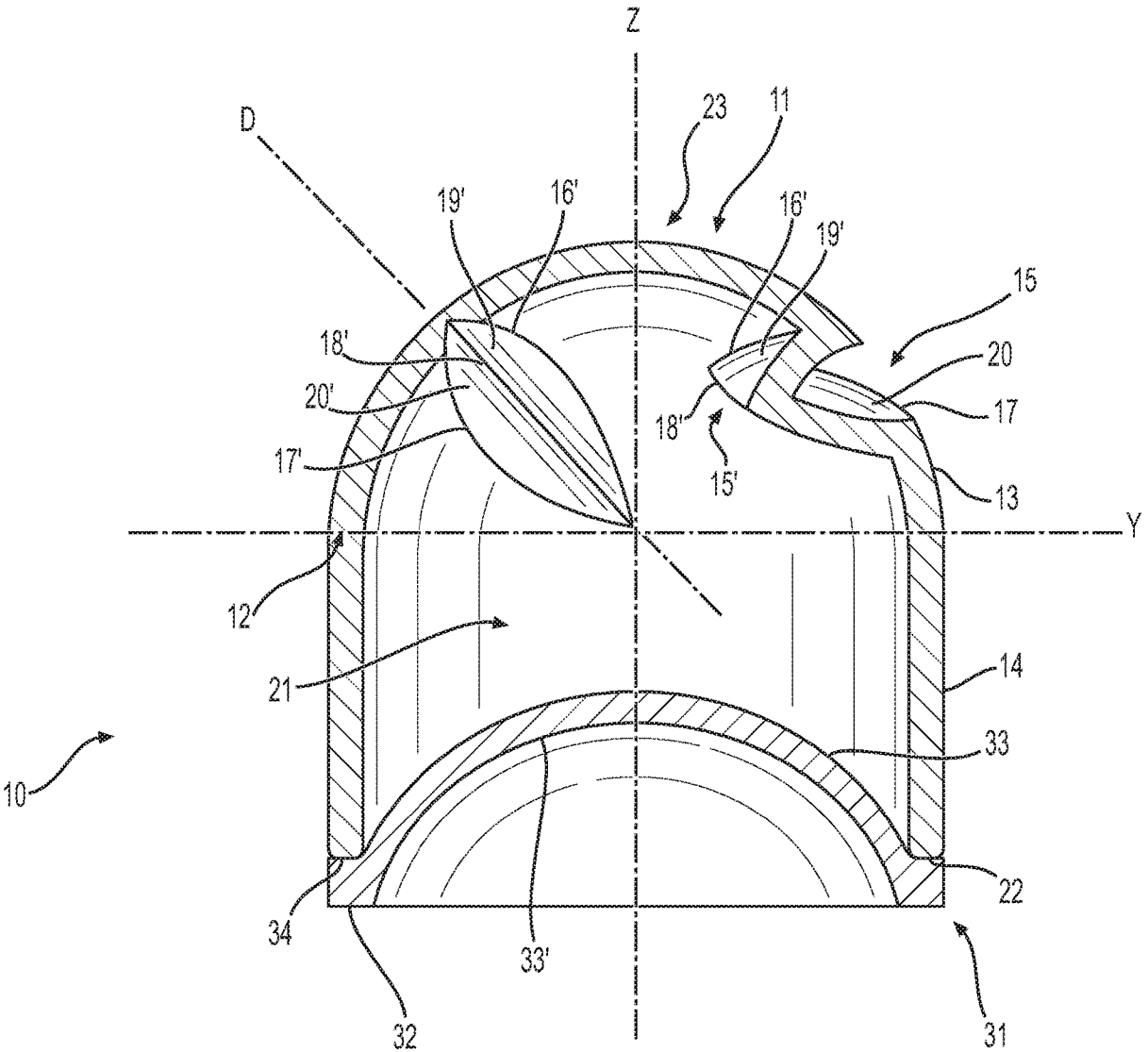
FIG. 5 shows a side cut away view of the projectile.

The projectile's 10 front shell 11 can be described as having a hemispherical shape, merged at its equator 12 with a cylindrical portion 14 of the same or substantially similar diameter. The hemispherical area 13 has, preferably, three or more bi-planar grooves 15, originating and equidistantly placed along the equator 12 and extending toward the nose or pole 23 at a radial angle in an inward whorled manner, terminating around the apex of the hemisphere 13. As shown in FIG. 4, the three grooves 15 originate near the equator 12, where the hemispherical front portion 11 meets the cylindrical shaft 14. The grooves 15 are space equidistantly from each other along plane defined by the x and y axes at the equator 12; thus, measured counterclockwise, one of the grooves 15 originates on the equator 12 along the y axis at 0 degrees, another groove 15 at 120 degrees B, and the third groove 15 at 240 degrees C. The angle D of the grooves 15 when measured from the xy plane along the equator 12 vertically along the z axis is, preferably, in the range between 30 degrees and 60 degrees. It will be appreciated that two grooves 15 or more than three grooves may be employed. The angle E of the two sides, 19 and 20, of the grooves 15, when measured transverse to their longitudinal path or edge or apex 18, is, preferably, in the range from between 60 and 95 degrees. The front hemispherical portion 13 of the shell 11 has outer and inner surfaces of consistent wall thickness and defines the interior volume cavity 21 to contain the payload (not shown). The outer surface of the cylindrical portion 14 may be smooth or may be of a textured design intended to reduce friction while passing through the barrel when launched. The shell 11 may be molded of a frangible material intended to disintegrate on impact with an intended target and release the payload. The interior 21 of such a molded shell 11 will, therefore, have complimentary inner grooves 15' with, grooves edges 18', forward 16' and side 17' facing edges, and forward 19' and side 20' facing faces. The second base part 31 of the projectile has a domed 33 shape with an annular ring 32 of the same or substantially similar diameter as the cylindrical portion 14 of the shell H. The annular ring 32 of the base 31 also may act as an obturating ring, forming a seal with the bore of a launcher, and the convex inner surface 33' of the dome 33 has a profile complimentary to the hemispherical surface 13 of the shell 11, but lacking the presence of the bi-planar grooves 15. The base 31 has a wall thickness similar to that of the shell 11. The base 31 forms the back or tail portion of the projectile 10 that, when assembled, creates an enclosed cavity 21 intended to contain a variety of non-lethal compounds, such as irritant powders or marking or paint compounds.

The grooves 15 on the hemispherical portion 13 of the shell 11 create a spin stabilizing gyroscopic effect when forcefully expelled through a smooth bore barrel to deploy the projectile 10. The projectile 10 is comprised of a frangible material that is intended to disintegrate on impact with the intended target and release the payload (not shown), thereby creating the desired effect.

The assembled projectiles 10 are designed to nest in a nose 23 to tail 33' manner, thereby protecting the nose 23 of the following projectile 10 from damage when loaded into a multiple round magazine. The hemispherical shape of the nose portion 23 and tail 33' will allow for both linear and arched or circular positioning of the projectiles. The convex tail design 33' also creates a more nose forward center of gravity whereby increasing the aerodynamic stability of the projectile.

The present invention has been tested and the results are shown in the table of FIG. 6. Two commercially available non-lethal projectiles and eight variations of the disclosed invention were tested for their spin generation capability using wind tunnel testing at 92 CFM (cubic feet per minute) generated wind velocities of 106 feet per second (fps), 281 fps and 367 fps. The terminal velocity spin rates, in revolutions per second, are shown. Projectiles of the type for which the invention is intended are typically launched at muzzle velocities from 100 to 300 fps. In the tests, each projectile was fixed axially in a nearly friction-less manner in the air stream of the wind tunnel and the terminal velocity of rotation of the projectile was measured using a digital tachometer.

In addition to wind tunnel testing, the aerodynamic stability of the non-spinning projectiles were tested using a "drop tank" consisting of a 6 inch diameter by 6 foot transparent acrylic tube. The drop tank was placed in an upright position and filled with water. Each projectile was carefully placed slightly below the surface of the water to allow any entrained air bubbles to be released, then the projectile was allowed to fall. The test was duplicated 5 times for each projectile and the projectile's path through the water was observed and described. The purpose of the drop tank test was to determine the propensity of the projectile to tumble in flight. A projectile with a rear or centrally located center of gravity tends to tumble in flight, which creates an unpredictable flight path. While a very nose heavy design does not tend to tumble in flight, it does however have an arching flight path, like that of a badminton shuttlecock and must overcome the gravitational effects by increased velocity. A flat trajectory is the preferred flight path for a projectile of this type for it exhibits increased accuracy. This testing showed that the present design has significantly improved anti-tumble characteristics compared to commercially-available projectiles.

The drawings and description set forth here represent only some embodiments of the invention. After considering these, skilled persons will understand that there are many ways to make a non-lethal projectile according to the principles disclosed. The inventor contemplates that the use of alternative structures, materials, or manufacturing techniques, which result in a non-lethal projectile according to the principles disclosed, will be within the scope of the invention.

The invention claimed is:

1. A projectile for containing a payload and for discharge from a launcher comprising:

a front shell having an axis, an outer surface, a hemispherical nose with a tip aligned with the axis, and an equator defining an equatorial plane substantially normal to the axis, the hemispherical nose having a plurality of equidistantly spaced linear grooves in the outer surface originating proximate to the equator and extending toward the tip at a nose angle greater than 30 degrees measured from the equatorial plane, wherein each of the plurality of equidistantly spaced linear grooves comprises a linear groove apex aligned with the nose angle, a converging nose end proximate to the tip and a converging equatorial end opposite the converging nose end, and wherein said front shell further comprises a cylindrical shaft extending from the equator away from the hemispherical nose to an annular bottom rim, and wherein the front shell and cylindrical shaft form an interior cavity adapted to hold a payload, and a base having a top surface, a bottom surface opposite the top surface, and an annular ring configured to form a seal with the annular bottom rim of the cylindrical shaft.

2. The projectile of claim 1 wherein the nose angle of the plurality of equidistantly spaced linear grooves is between 30 degrees and 60 degrees.

3. The projectile of claim 2 wherein the nose angle of the plurality of equidistantly spaced linear grooves between 30 degrees and 45 degrees.

4. The projectile of claim 2 wherein each of the plurality of equidistantly spaced linear grooves further comprises a pair of groove edges along the outer surface of the outer surface of the hemispherical nose, wherein each of the pair of groove edges is disposed opposite each other and substantially aligned with the linear groove apex, and wherein a radial groove angle between the groove edges is between 60 degrees and 90 degrees when measured radially from the linear groove apex.

5. The projectile of claim 1 wherein the bottom surface of the base forms a dome directed toward the tip of the hemispherical nose and wherein the dome has a profile complimentary to the outer surface of the hemispherical nose of the front shell.

6. The projectile of claim 5 wherein the bottom surface of the base further comprises an annular ring forming an obturating seal with a barrel of a launcher.

7. The projectile of claim 1 wherein the payload is non-lethal.

8. The projectile of claim 1 wherein the front shell made of a frangible material that will break upon impact with a target and release the payload.

9. A projectile shell having an outer surface comprising:

a hemispherical portion having a pole, an equator opposite the pole, and an interior, wherein the outer surface of the hemispherical portion comprises at least two linear slices extending at a slice angle greater than 20 degrees and less than 90 degrees from the equator toward the pole, wherein each slice comprises an apex aligned with the slice angle and a pair of slice faces extending from the outer surface of the hemispherical portion to the apex, and wherein each slice comprises a first converging point proximate to the equator and a second converging point opposite the first converging point, a cylindrical sidewall extending from the equator of the hemispherical portion away from the pole, and a sidewall inner space, wherein the interior and the sidewall inner space form a cavity configured to contain a payload, a base enclosing the cavity, wherein the base further comprises a bottom surface configured to nest with the outer surface of the hemispherical portion of the shell.

10. The projectile shell of claim 9 wherein the slice angle is greater than 30 degrees and less than 60 degrees.

11. The projectile of claim 10 wherein the slice angle is greater than 30 degrees and less than 45 degrees.

12. The projectile shell of claim 9 wherein the pair of slice faces and the apex form a slice angle between the slice faces between 60 degrees and 90 degrees.

13. The projectile shell of claim 9 wherein the outer surface further comprises an annular ring forming an obturating seal with a barrel of a launcher.

14. The projectile shell of claim 9 wherein the projectile shell is made of a material that will break upon impact with a target and release the payload.

* * * * *